US005470171A

United States Patent [19]

Tseng

[11] Patent Number: 5,470,171

[45] Date of Patent: Nov. 28, 1995

[54] CONFIGURABLE HIGHWAY DIVIDER SYSTEM

[76] Inventor: Ling-yuan Tseng, 13772 Calle Tacuba, Saratoga, Calif. 95070

[21] Appl. No.: 104,881

[22] Filed: Aug. 10, 1993

[51] Int. Cl.[6] ..... E01F 9/087

[52] U.S. Cl. ..... 404/13; 404/16

[58] Field of Search ..... 404/1, 10, 11, 404/12, 13, 14, 16; 40/612, 491

[56] References Cited

U.S. PATENT DOCUMENTS

| | | | |
|---|---|---|---|
| 2,259,610 | 10/1941 | Bryson | 404/16 |
| 3,920,346 | 11/1975 | Wyckoff | 404/14 |
| 4,040,760 | 8/1977 | Wyckoff | 404/14 |
| 4,069,787 | 1/1978 | Wyckoff | 116/63 |
| 4,717,281 | 1/1988 | Shepherd et al. | 404/16 |
| 5,154,533 | 10/1992 | Baldea | 404/1 |

*Primary Examiner*—Ramon S. Britts

*Assistant Examiner*—Pamela Anne O'Connor

*Attorney, Agent, or Firm*—Gifford, Krass, Groh, Sprinkle, Patmore, Anderson & Citkowski

[57] ABSTRACT

A configurable highway divider system features a plurality of markers associated with a lane of traffic, each marker including one or more indicators observable by a vehicle operator traveling on the lane associated with the markers, and a indicator changing device that can be mounted to a vehicle, enabling the vehicle to visit and interact with the markers and change the indicators for the purpose of redirecting traffic flow. In a preferred embodiment, the indicators use reflective color surfaces, and an externally-engageable member which is mechanically linked to each indicator. In an alternative embodiment, the visual attribute displayed by the markers do not change, but, instead, an alternative indicator changing device is used to turn each marker about a substantially vertical axis either with a rotatable drum/disk combination or with a magnetic actuator. Further alternative embodiments incorporate the use of acoustic, optical and thermal interactions between the marker and the changing device.

15 Claims, 5 Drawing Sheets

FIG-11A
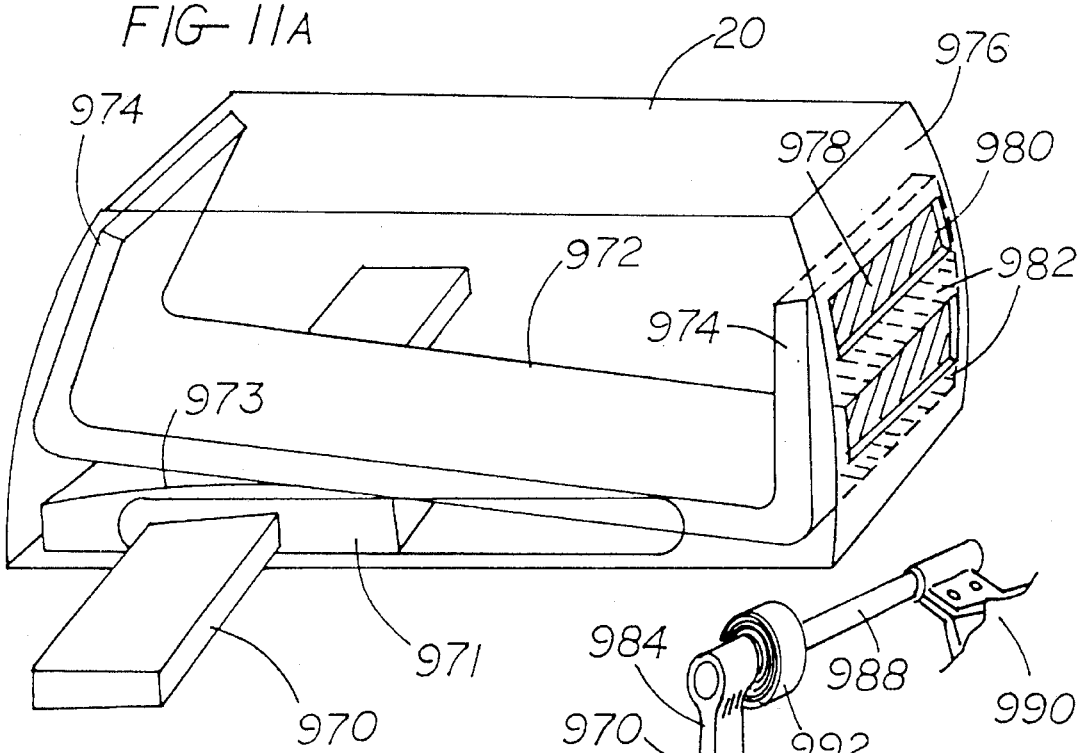
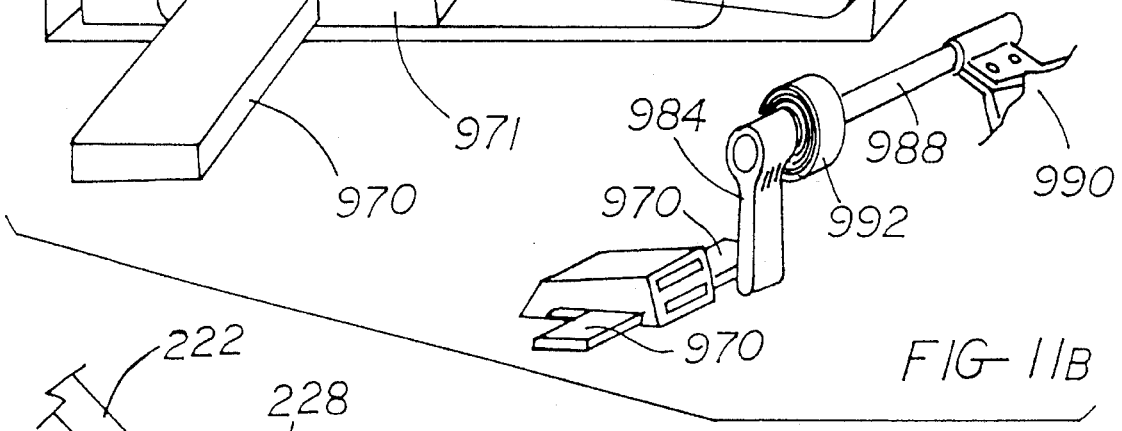
FIG-11B
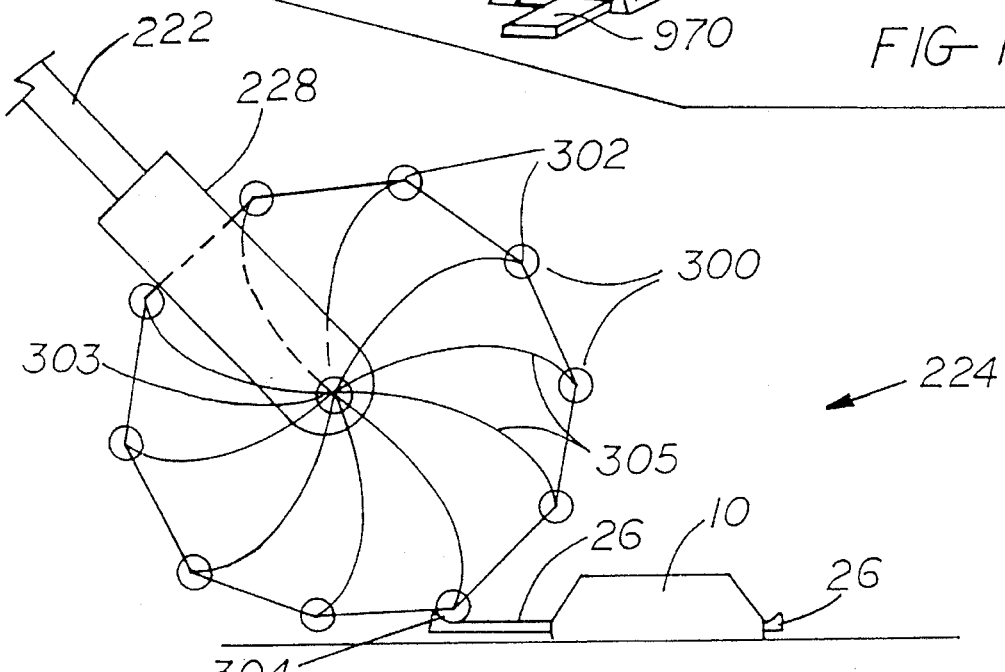
FIG-3

CONFIGURABLE HIGHWAY DIVIDER SYSTEM

FIELD OF THE INVENTION

The present invention relates generally to highway dividers and, in particular, .to a system including configurable highway markers and a vehicle mountable device used to change the markers for the purpose of redirecting traffic flow.

BACKGROUND OF THE INVENTION

It is well known that traffic congestion in and around metropolitan areas is a serious problem throughout the world. This problem is most critical during "rush hour", at which time numerous commuters attempt to enter and leave urban work centers. Various ideas have been tried to alleviate this situation, including the use of dedicated car-pool lanes, the staggering of work hours and work days, and financial incentives and penalties for those who help solve and compound the problem, respectively.

In many urban situations, traffic is congested in only one direction during rush hour, with one or more lanes in the opposite direction experiencing only light to moderate use. Various ideas have been implemented to better utilize the entire road surface during such congested periods. One idea is to use one or more lanes, usually center lanes, in both directions, and alternate the flow of traffic over such lanes to accommodate both "morning" and "evening" rush-hour periods. Different technologies have, in turn, been suggested or implemented to reverse traffic flow in accordance with the time of day, including overhead signs and surface-level barriers and indicators. These prior-art systems all present drawbacks, however. Illuminated signs and barriers are particularly expensive and difficult to install. As such, they must be used sparingly, and a vehicle operator may not see an indicator in time to realize the proper direction of travel, and an accident may occur. It is also possible to provide numerous lane-related indicators with a direction-changing capability, but this ordinarily leads to some form of centralized control or networking, which can also become expensive and hazardous should a malfunction occur.

Thus, there remains a need for a configurable highway divider system that is reliable yet inexpensive enough to avoid hazards through liberal application. Despite the availability of networking and computer control, traffic lane control may be one area where such sophisticated technology is either too expensive to install and maintain or too prone to malfunction to risk its use. An improved system would offer the flexibility of a more automated approach while including safeguards to ensure that potential hazards are avoided.

SUMMARY OF THE INVENTION

The present invention overcomes prior art limitations by providing a configurable highway divider system which is inexpensive to install and maintain, and which is controlled in such a way that malfunctions are essentially eliminated. A plurality of highway markers are installed along a lane to be controlled, each having at least one indicator such as a color reflector, which may be observed by vehicle operators in order to determine the proper direction of travel along that lane. To change the direction of travel, a vehicle mountable indicator changing device is used to interact with each marker on an individual basis to alter the indicator observable by a vehicle operator.

In the preferred marker configuration, the interaction between the vehicle-mounted indicator changing device and the marker is mechanical. Each marker includes an externally engageable member mechanically linked to its indicator, and each indicator is capable of displaying a plurality of visual attributes. The vehicle-mounted indicator changing device is equipped with elements designed to engage with the externally engageable member of each marker, so that when a vehicle equipped with the changing device travels proximate to the markers and interacts with them, a different visual attribute is observable on the indicators through the engagement with the changing device. In this configuration, the housing of the marker contains one or more apertures through which the indicator is viewed. A plurality of visual attributes are disposed on the indicator, such that only one type of attribute is viewable through the aperture at any one time. When the indicator changing device interacts with the marker, a different visual attribute is observable through the aperture after the changing device properly engages with the marker's externally engageable member.

If the markers are to be used to direct traffic in one of two directions along a single lane associated with the markers, the ends of each marker observable by vehicle operators traveling in the two directions each include an indicator linked to the externally engageable member. After interaction with the indicator changing device, the visual attributes presented by the two indicators are typically swapped, thus reversing the intended flow of traffic along the lane associated with the marker. In an alternative embodiment, three visual attributes are associated with each indicator and the externally engageable member may be moved through three states for more complex traffic routing.

In a further alternative embodiment, the visual attributes of the indicators on a marker do not change, but the marker is instead rotated about a substantially vertical axis so that the indicators seen by the vehicle operators traveling in the two directions are reversed through rotation of the marker. In this case the indicator changing device is in the form of a drum rotatable about a vertical axis with elements disposed around the periphery of the drum which engage with an appendage of the marker or the marker itself, and turn it about its axis. A lifting plate is preferably used in conjunction with the drum to lift the marker prior to its rotation.

Although the preferred embodiments make use of a mechanical linkage from an externally engageable member linked to one or more indicators in each marker, acoustical, thermal or optical engagement mechanisms may alternatively be utilized. For example, a vehicle equipped with an indicator changing device may travel proximate to the markers and to impart sound of a particular loudness or frequency, heat or light, with the indicators being designed to respond accordingly.

BRIEF DESCRIPTION OF THE DRAWINGS

FIG. 3 is a side-view drawing of the indicator changing device interacting with a single marker;

FIG. 11 shows a marker having an externally engageable member in the form of a lever.

DETAILED DESCRIPTION OF THE PREFERRED EMBODIMENT

Figure 1:
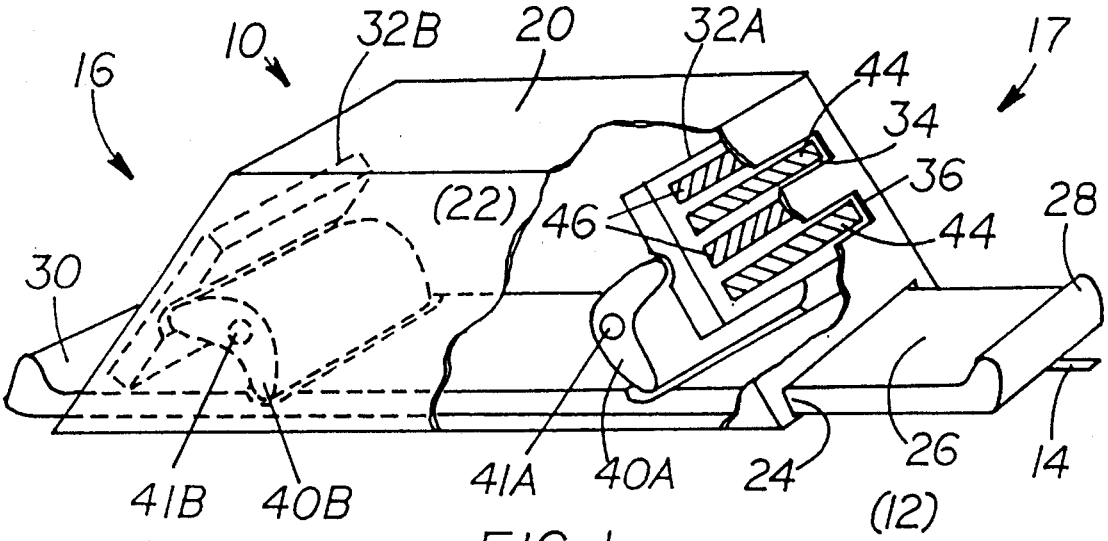
FIG. 1 shows a configurable marker formed in accordance with the present invention.

Referring to FIG. 1, there is shown an oblique illustration of a configurable marker 10 formed in accordance with the present invention. In a typical installation, the marker is placed between lanes of traffic 12, the broken line 14 being used to indicate generally the interface between lanes 12. The marker may be used with or without the painted lines ordinarily used along line 14 between lanes 12.

Generally speaking, marker body 10 is preferably rectangular when viewed from above, the longest sides of the rectangle being parallel to the flow of traffic along lanes 12. When viewed from the side indicated by arrow 10, however, the marker takes upon a trapezoidal shape having sloped sides 16 and 17 such that the vehicle operators traveling from right to left in FIG. 1 may easily see surface 17, whereas the vehicle operators traveling from left to right in the figure may easily view surface 16.

Marker 10 is constructed with a housing 20 composed of rigid material such as metal. Area 22 in FIG. 1 has been broken away to expose the inner workings of this marker embodiment. Disposed along the marker body 10 and projecting through openings 24 in both sloped sides 16 and 17 of body 10 is a slidable externally engageable member 26 having a first end with raised lip 28 and a second end with raised lip 30. These raised lips are formed to engage with the indicator changing mechanism, which will be described fully with respect to FIG. 2.

Continuing the reference to FIG. 1, within marker housing 20, two plates 32 are disposed which move relative to slot-like apertures formed in slanted walls 16 and 17. Representative apertures 34 and 36 are shown, being formed through wall 17. Side wall 16 includes similar apertures, and though FIG. 1 only depicts two such slot-like apertures per sloping wall, many more than two openings may be used so long as the openings are in agreement with the visual indicators, which will be described shortly.

Within housing 20 of marker body 10 there are two cam-shaped linkages 40 which convey the motion of slider 26 to plates 32. In FIG. 1, slider 26 has been pulled to the right, and this has caused cams 40 to rotate counterclockwise about their axes 41. This, in turn, has caused plate **32*a* to move upwardly with respect to surface 17, and plate 32*b* to move downwardly with respect to surface 16. It should be noted that although a cam-linkage between slider 26 and plates 32 has been shown in FIG. 1**, any alternative mechanical linkage may be used, including multiple hinges and/or gear trains.

With slider 26 pulled to the right as shown in FIG. 1, indicators 44 having a first visual attribute such as a reflective color surface may be viewed through windows 34 and 36 by a vehicle operator traveling from the right to the left in FIG. 1. At the same time, with plate **32*a* being moved upwardly by cam 40*a* along guides (not shown), a second set of indicators 46 are obscured behind sloped wall 17, as they are not directly disposed behind windows 34 and 36. Although this oblique drawing does not provide details of surface 16, the mechanisms behind surface 16 behave opposite to that of surface 17 as slider 26 is pulled. That is, as slider 26 is pulled to the right, having rotated cam 40*b* counterclockwise about its axis 41*b*, plate 32*b* is shifted downwardly with respect to surface 16, causing the indicators disposed on surface 32*b* to be different from those on 32*a*, as viewed through their respective windows. In this way, vehicle operators traveling in one direction view an indicator which tells them that it is safe to travel in that direction, whereas vehicle operators traveling in the opposite direction see an indicator which tells them otherwise. By pulling slider 26 to the left in FIG. 1, however, this shifts plate 32*a* downwardly and plate 32*b* upwardly with respect to their respective windows, thereby changing the direction of safe travel along lanes 12** in accordance with traffic conditions.

Figure 2:
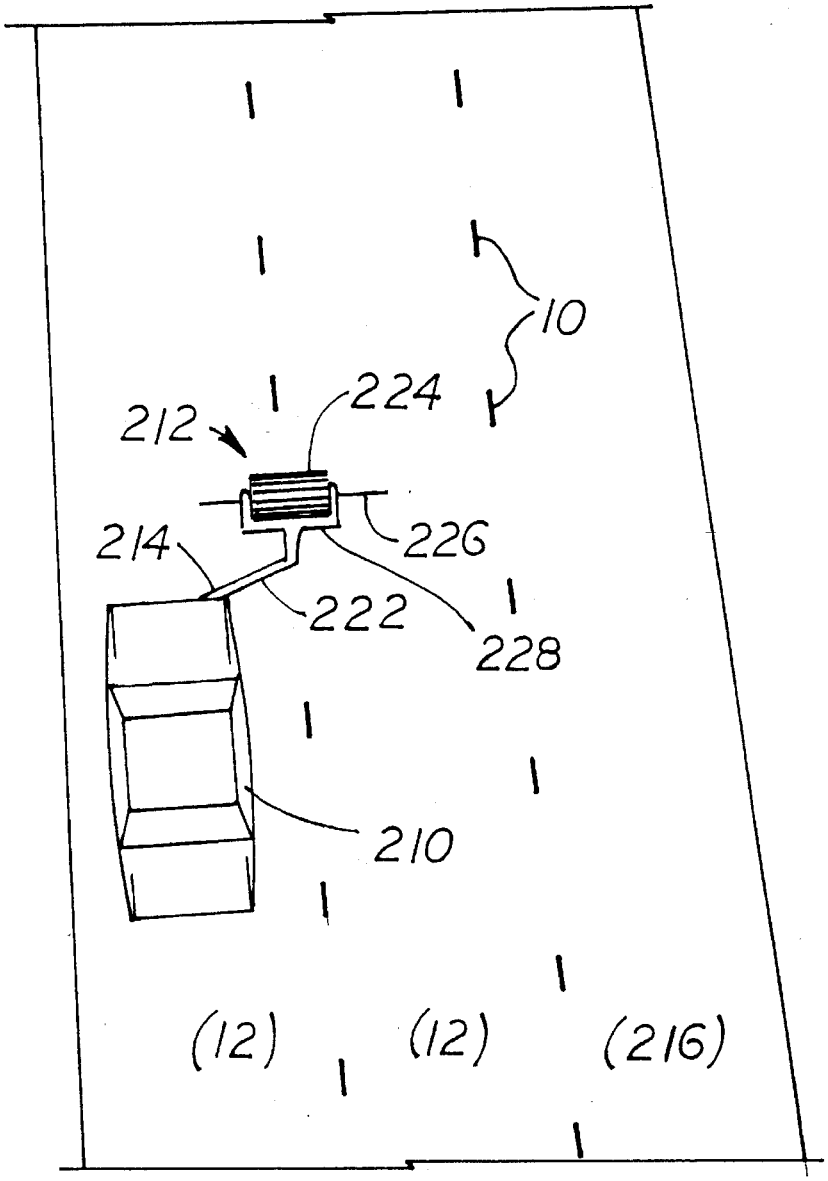
FIG. 2 is a top-view drawing of a vehicle equipped with an indicator changing device used on a road surface with the configurable markers installed.

Turning now to FIG. 2, there is shown a top-view drawing of a vehicle 210 equipped with an indicator changing device shown generally at 212. In the preferred embodiment, changing unit 212 is affixed to a portion of the vehicle around its periphery, for instance, by bolting to a bumper at point 214. In the example shown, indicator changing device 212 is affixed to a rear bumper, and the vehicle is traveling downwardly on the page of FIG. 2. However, the device may also be mounted upon a front bumper. All that is necessary is that the device roll over the configurable markers in a manner that will now be described.

In FIG. 2, for the sake of illustration, lanes 12 are separated by the configurable markers of the present invention, whereas lanes 216 and the lane 12 to which it is closest are separated by non-configurable markers 220. As such, the direction of traffic along lanes 12 may be reversed in accordance with the state of the indicators on configurable markers 10.

Indicator changing device 212, being attached to vehicle 210 at point 214, utilizes an arm 222 which places a rotatable drum 224 off to the side of vehicle 210 that as drum 224 rotates about axis 226 within fork-shaped support 228, the ground covered by the rotating surface of drum 224 and that covered by vehicle 210 are offset from one another, enabling the vehicle to travel along within the confines of the traffic lane, while drum 224 rolls over the configurable markers 10.

FIG. 3 is a close up, side view drawing of the interaction between drum 224 and a configurable marker 10. Drum 224 is comprised of members 300, which, in the preferred embodiment, take the form of elongated cylindrical elements, each having an axis 302 being transverse to the direction of traffic flow along the road surfaces with which marker 10 is associated. In the preferred embodiment, each cylindrical element is rotatable about its own axis 302, though such rotation is not an essential element of the present invention. In fact members 300 need not be cylindrical, for instance, they may have one or more flat sides. All that is necessary is that the cross-sectional geometry of members 300 be substantially smaller than the diameter of drum 224. In this way, as drum 224 rolls over marker 10, elements 300 may engage with marker slider 26 at point 304. Members 300 are preferably attached to the central axis 303 of drum 224 by way of springs 305 so that the overall outer shape of the drum may deform as it rolls over marker 10. It should also be noted that normal vehicle tires, not having members 300, do not switch the state of the markers if one or more of these tires inadvertently rolls over a marker.

In the example shown, drum 224 is rolling in a clockwise fashion as the changing mechanism proceeds toward the right of the drawing, so that as one of the elements 300 engages with slider 26 at point 304, the slider is pulled toward the left. Referring back to FIG. 1, by pulling slider 26 toward the left, indicators 44 are obscured with respect to surface 17 and indicators 46 are now viewable through windows 34 and 36. The indicators viewable upon surface 16 are reversed in like fashion.

Given a configurable marker having a slider which engages with a multiple-element drum on the indicator changing device, several alternative mechanisms internal to the marker are possible. For example, in FIG. 4, there is shown a simplified marker having two diagonally translatable plates 400 and 402 which move along planes 401 and 403, respectively, via tracks provided by guides 406. Plate 400 is optionally bent to form a horizontal bottom surface 410 to improve the mechanical action which will now be described. Plate 402 is similarly bent to form a corresponding horizontal surface 412.

Figure 4:
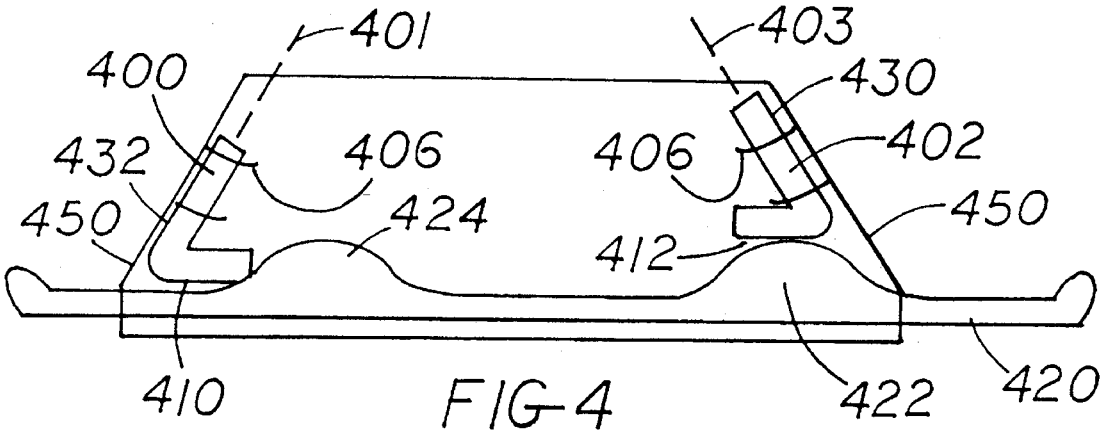
FIG. 4 is a side-view cross-section of a marker incorporating an alternative internal configuration mechanism.

In FIG. 4, slider 420 having bumps or raised areas 422 and 424, is pulled rightwardly in the figure. This causes raised area 422 to push upon surface 412, thereby causing 402 to move upwardly along line 403. Visual indicators are formed on the surface 430 of plate 402 and surface 432 on plate 400, which may be viewable, or not viewable, in accordance with the slider position through apertures formed on the diagonally sloping walls 450. Viewed externally, the functioning of the marker in FIG. 4 is identical to that in FIG. 1, the only difference being the way in which the slider is mechanically linked to the indicators. With slider 420 pulled rightwardly, as in FIG. 4, bump 424 is also moved out from under surface 410, allowing plate 400 to fall along diagonal line 401. As such, indicator 430 is always raised while indicator 432 is down or indicator 432 is raised while indicator 430 is down.

Figure 5:
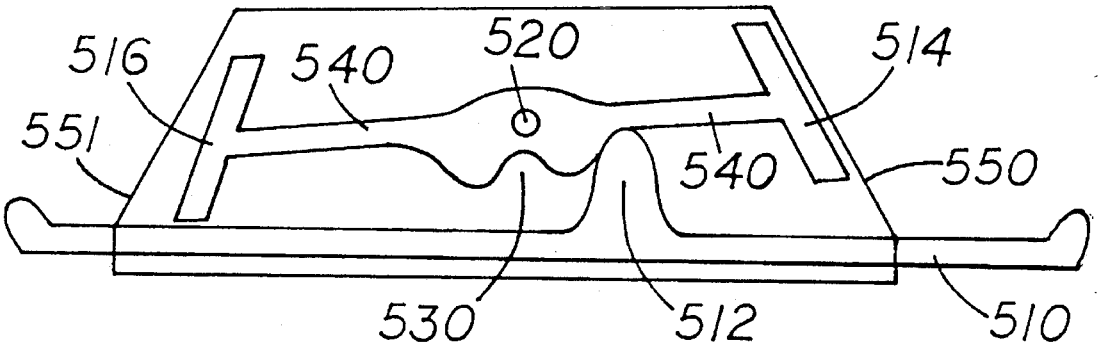
FIG. 5 is a side view of yet another alternative marker, each indicator having three states.

A different alternative marker is shown in FIG. 5. In this case, slider 510 is formed with a single raised area or bump 512. With slider 510 pulled to the right, as shown in FIG. 5, it causes bump 512 to be to the right of axis 520, which causes plate 514 to be raised with respect to wall 550, and plate 516, along with its indicators, to fall relative to wall 551.

Viewed externally, the functioning of this alternative marker is identical to that in FIGS. 1 and 4 with one important exception. A depression 530 has optionally been added just beneath axle 520, allowing bump 512 to seat in depression 530, causing arm 540 to be substantially horizontal, and plates 514 and 516 to be equidistant from the road surface. Through careful monitoring of the indicator changing device as it rolls over the marker of FIG. 5, three indicator positions may thus be available on each sloped wall of the marker. Depending upon the number of windows associated with the indicator panels, this may be used to show three distinct indicator attributes, such as three different colors, or two attributes and a third position where all attributes are obscured and no colors are shown.

Figure 6:
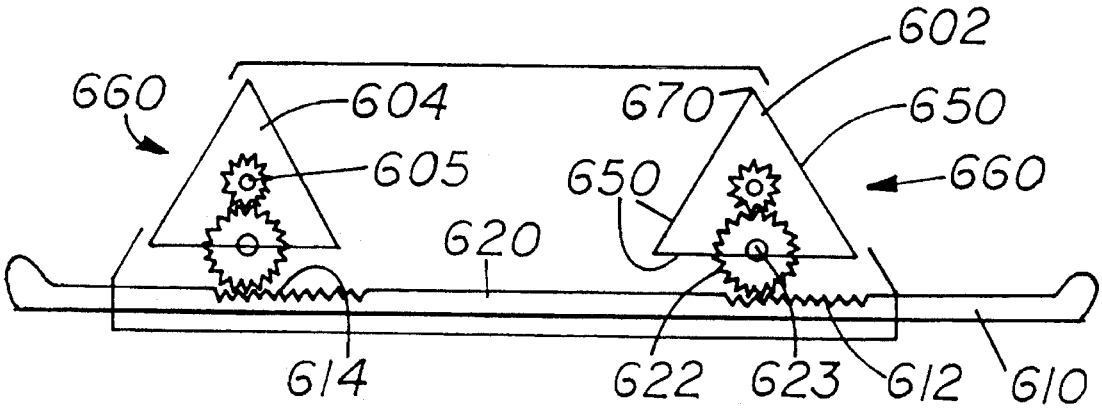
FIG. 6 is a side-view schematic of an alternative configurable marker wherein the indicator surfaces are placed on the sides of rotatable prism-shaped elements within the marker housing.

Turning now to FIG. 6, there is shown yet another configurable marker construction, this embodiment placing the indicator surfaces upon prism-shaped structures 602 and 604, the prism structures being rotatable about axes 603 and 605, respectively. Slider 610 is in this case formed with teeth 612 adapted to mate with element 602 and teeth 614 adapted to mate with element 604, though to ease manufacturing, teeth may be formed along the entire upper surface 620 of slider 610. Teeth 612 engage with gear 622, which is rotatable about axis 623. Movement of gear 622 about axis 623 is transferred to gear 626 which is affixed to prism-shaped member 602, causing it to turn in conjunction with gear 626. Visual indicators are provided on one or more surfaces 650 of each of the two rotatable prism-shaped elements shown, and large windows 660 are provided along the sloped sides of the marker so that the prism-shaped members may move about their axes. The windows 660 are dimensioned such that the points of the triangular cross-section, such as point 670 will "clear" as the prism-shaped members rotate about their axes.

Slider 610 is pulled to the right in FIG. 6, causing the prism-shaped members to come to rest as shown in the figure. As the slider is pushed leftwardly, mechanical energy is transferred from the teeth on slider 610 through gears 622 and 626, thus simultaneously turning both of the prism-shaped members. Depending upon overall geometric constraints, the number of gears associated with the marker embodiment shown in FIG. 6 is variable. For example, gear 626 may be made large enough to interact with teeth 612 directly, without the need for gear 622, if slider 610 is made sufficiently long. An additional possibility is that if teeth are provided along surface 620, a single gear, not shown, may be used to interact with both of the smaller gears associated with the two prism-shaped members.

Figure 7:
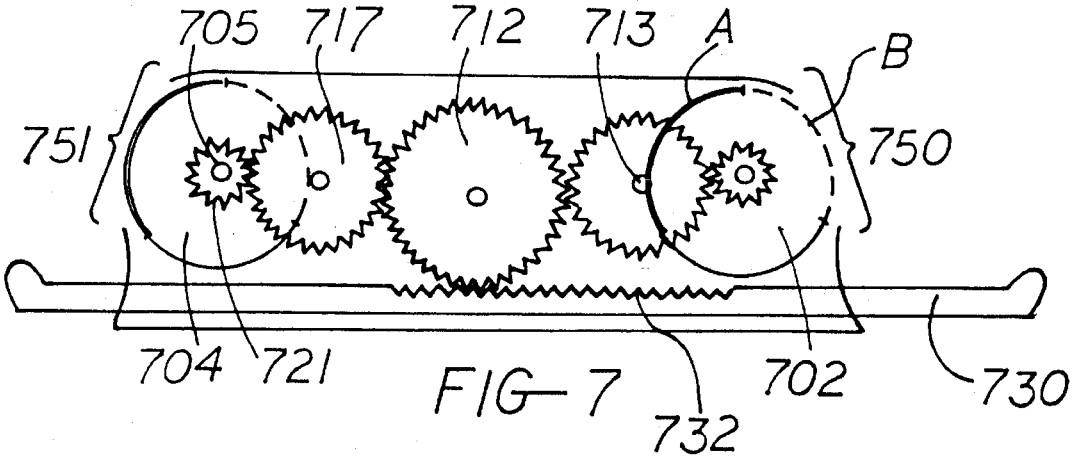
FIG. 7 illustrates an alternative marker construction wherein the indicator surfaces are placed upon rotatable cylindrical drums within the marker housing.

This single, central gear arrangement is shown in FIG. 7 with respect to an embodiment having the indicators placed upon rotatable cylinders 702 and 704, which are rotatable about axes 703 and 705, respectively. The central gear, 712, is shown to be rotatable about an axis 713, this rotational movement being coupled to cylinder 702 and 704 via gears 715 and 717, respectively. Gears 715 and 717 are, in turn, coupled to smaller gears, 719 and 721, respectively, which are attached to cylinders 702 and 704, thereby rotating cooperatively therewith.

Slider 730 is provided with teeth 732 which mate with the teeth on gear 712 to distribute the mechanical energy required to turn the indicator-bearing cylinders. Depending upon the overall geometrical requirements of the marker and the length of the slider, more or fewer gears may be used to sufficiently turn the cylinders so as to properly align them relative to windows 750 and 751 shown at the rightmost and leftmost ends of the marker housing in FIG. 7. These windows may be large, isolated windows or may take the form of elongated slits, as shown explicitly in FIG. 1, depending upon the precise indicator implementation.

In FIG. 7, three different indicator surfaces A, B, and C are disposed on the walls of cylinders 702 and 704, though any arrangement of two or more such different surfaces or attributes are possible. With slider 730 positioned as shown in FIG. 7, surface "B" is visible through window 750, whereas surface "A" is viewable through window 751. With precise management of the changing device as it passes over a marker constructed in accordance with FIG. 7, one of the three visual attributes will be visible through both of the window 750 and 751, though, with the configuration shown, at no time will the same indicator surfaces be viewable through both of the windows.

Figure 8B:
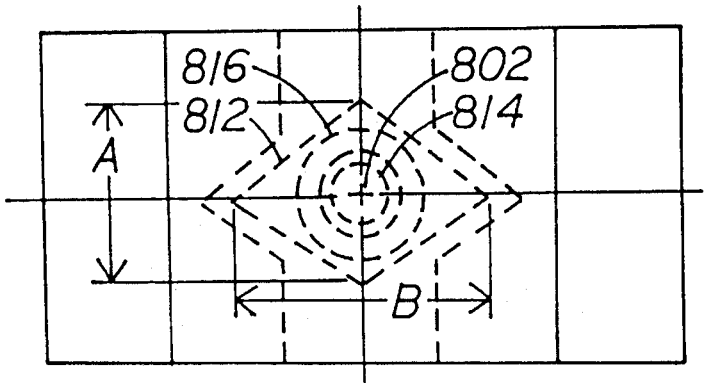
FIG. 8 is a top view of an alternative marker which is configured by rotating the marker 180 degrees about a central vertical axis.
Figure 8A:
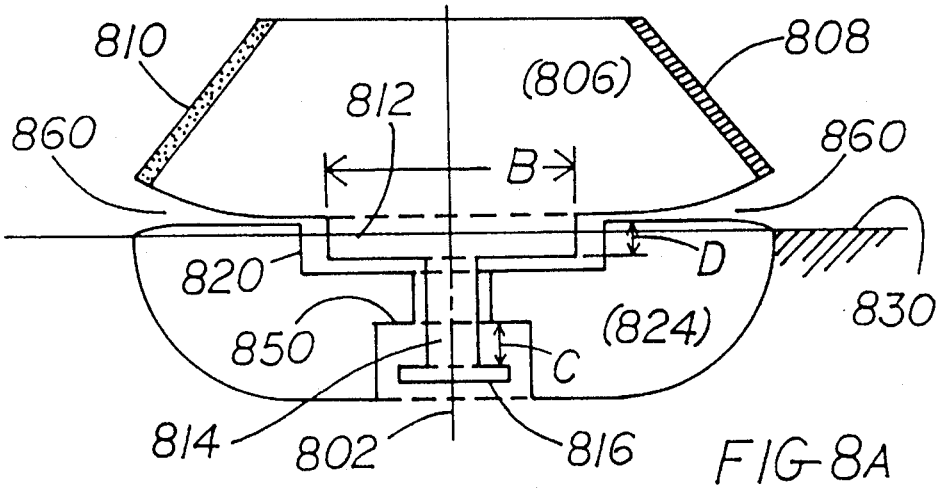
Figure 9:
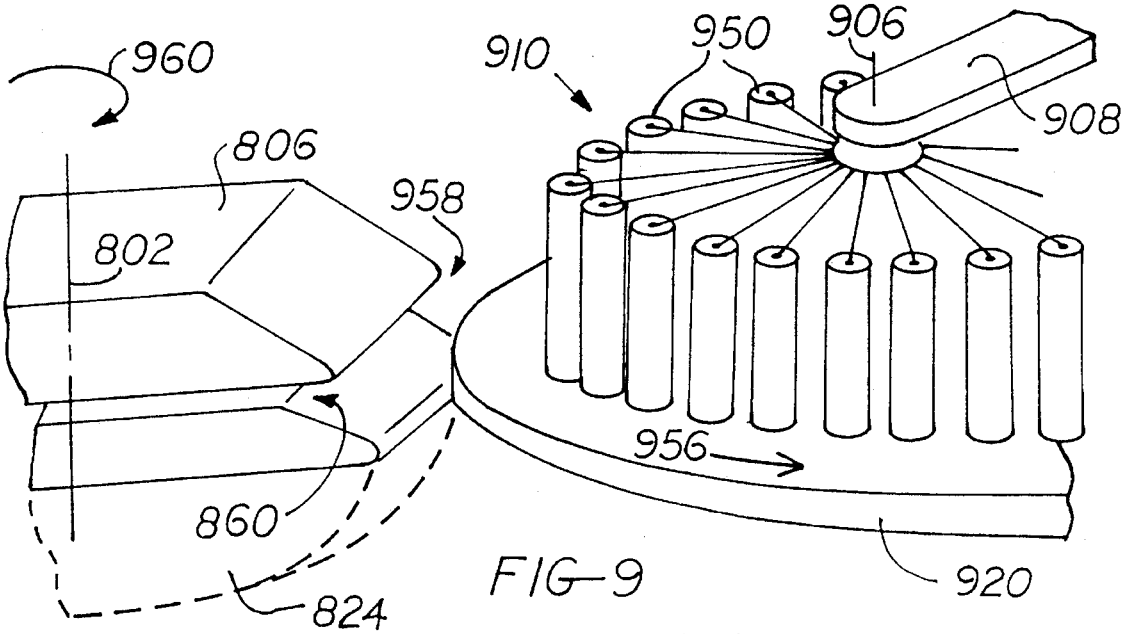
FIG. 9 is a side-view cross-section of the marker of FIG. 8.
Figure 10:
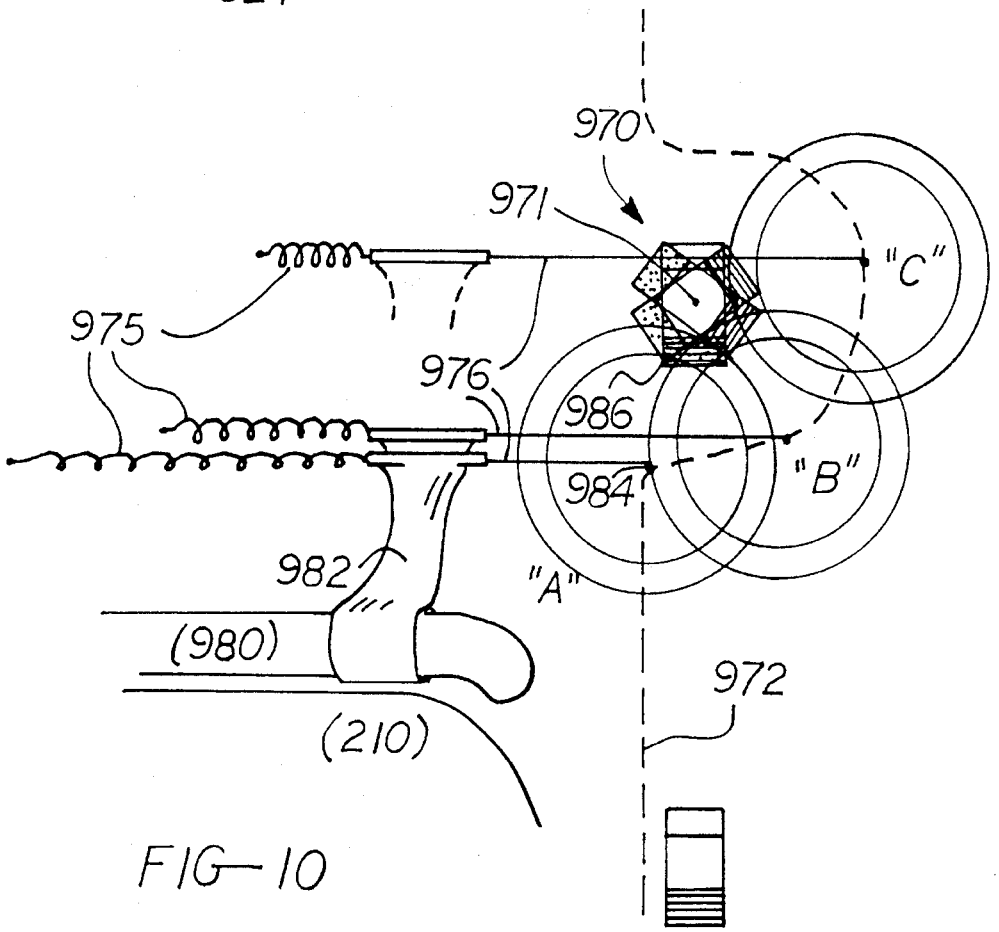
FIG. 10 shows a preferred indicator changing device for use in conjunction with the rotatable marker of FIGS. 8 and 9.

FIGS. 8, 9 and 10 are associated with a different type of alternative configurable marker which does not use a slider to alter the indicator states. Instead, the end surfaces of the marker have a permanently applied visual attribute, and the indicator changing device is used to rotate the marker about a substantially vertical axis, preferably through 180 degrees, thus changing the indicators seen relative to the two directions of traffic associated with the marker. Although the marker is preferably turned 180 degrees to effectively "reverse" the state of the indicators, it is also possible to have indicators on other sides of the marker, i.e., on all four sides, and thus turn the marker through 90 degrees so as to bring about a change in the indicators seen by vehicle operators. It is also possible that the marker, when viewed from above, is triangular or circular, as it is only necessary for this embodiment that the marker be rotatable by the indicator changing device so as to alter the attributes perceived by vehicle operators traveling in different directions.

Now making reference to FIG. 8, there is shown a top view of a marker which is configurable through rotation about axis 802. The marker of FIG. 8 comprises a main body 806 having sloped side walls 808 and 810, each bearing a different visual indicator surface. Integrally formed with body 806 is a base 812 and a stem structure consisting of axle 814 and stopper 816. Base area 812 of body 806 is formed to cooperate with a similarly shaped depression 820 is a stationary foundation structure 824 which is embedded beneath road surface 830. The bottom shape of structure 824 is preferably rounded to fit into depressions formed in the road surface with commonly available circular cutting tools.

Importantly, the structure of base 812 is such that it may only come to rest within depression 820 along very specific orientations relative to the road surface. In the preferred embodiment, the shape of base 812 resembles that of a diamond having a first dimension "A", most easily seen in FIG. 8*b*, and a second dimension "B", best seen in FIG. 8*a*, wherein "A" is smaller than "B". Thus, in the preferred construction shown, marker body 806 with base 812 may only be seated within depression 820 in the configuration shown in FIG. 8*a*, or marker 806 may be lifted and rotated 180 degrees for a second possible seating arrangement. The shape of base structure 812 may take on various alternative geometries, including that of an ellipse, or a square, wherein the latter will afford four different seating positions. It is only necessary to remain within the scope of the present invention that the marker have at least two discrete seating points with respect to the road surface and traffic flow.

In order to turn marker body 806, it must be lifted relative to road surface 830, which raises base structure 812 from depression 820 so that body 806 may rotated about axis 802. Stop 816 is provided upon axle 814 to ensure that body 806 may never be lifted entirely from its foundation unit 824. The distance "C" is intentionally made larger than the distance "D" to ensure that base 812 may be raised sufficiently from depression 820 before stop 816 reaches surface 850 of the foundational unit.

FIG. 9 illustrates a preferred indicator changing mechanism associated with the rotatable marker depicted in FIG. 8. Widened gaps 860 are provided between the body 806 and the foundational structure 824, these gaps 860 being provided on both traffic-facing ends of the marker. A vehicle (not shown), is equipped with a indicator changing device having a rotatable drum, though, in this embodiment, the drum is rotatable about a substantially vertical axis 906. An arm, 908, is used to link the rotatable drum, depicted generally at 910, to the vehicle equipped with the changing unit. Disposed along the bottom of drum 910 is a plate 920 which preferably increases in thickness from its outer circumferential edge toward its center, so that as plate 920 enters gap 860, body 806 is gradually lifted with respect to foundation unit 824 prior to turning. As an alternative to the plate 920, a magnet (not shown) may instead be used to lift the marker body.

Once the upper marker 806 is lifted from its foundation and the road surface, it may be rotated as elements 950 come closer to body 806, eventually engaging with one of its outwardly disposed edges. For example, with drum 910 rotating counterclockwise, as shown by arrow 956, and as platen 920 enters gap 860, lifting body 806, at some point, one of the smaller elements 950 will strike a protruding surface of 806 such as point 958, thereby causing marker body 806 to rotate in a clockwise direction about its axis, as viewed from above, and as shown by arrow 960.

FIG. 10 is a top-view schematic showing the changing unit of FIG. 9 and its movement with respect to the road surface as a representative marker 970 is turned about its axis 971. This figure shows three positions, "A", "B" and "C" along a path 972 that the axis of the rotatable drum would take as it travels around marker 970 as it is turned. A spring 975 may optionally be used on a rod 976 used to attach the rotatable drum to a vehicle bumper 980 via arm 982. As the center point of the drum 984 moves toward the marker 970 the smaller elements 950 (not shown), disposed along the outer surface of the drum, first catch a corner 986 of marker 970. As the vehicle 210 continues to travel upwardly in FIG. 10, the drum is carried along path 972, indicated with broken lines, from position "A" to position "B" to position "C", and so on, until marker 970 is turned, 180 degrees in this case, about its axis 971. As the drum is pulled rightwardly as the marker is turned, spring 975 is compressed allowing the forward motion of vehicle 210 to occur essentially a straight path as drum follows path 972. Arm 982 affixed to bumper 980 may also optionally contain hinge points to further ensure smooth travel of a vehicle equipped with the changing device as markers are subsequently turned.

FIG. 11 illustrates yet another alternative embodiment of a configurable marker, in this case utilizing a horizontally disposed lever 970 which protrudes form the sides of the marker housing 20. Internal to the marker a rocker plate 972 is disposed, the plate being bent upwardly at its ends to form plates 974 upon which indicators are affixed. The horizontal lever 970 is connected to a slidable block 971 incorporating an upper rounded surface 973, which permits easier movement relative to the rocker 972. On the end surfaces, one of which is depicted at 976, there are formed one or more apertures, one of two on surface 976 being indicated at 978. Through these apertures a first type of visual indicator, again, preferably a color reflective surface 980 is viewable through aperture 978, whereas a second visual indicator 982 remains obscured behind surface 976 with the lever 970 and rocker 972 in the position shown in the illustration. With the lever 970 pushed rightwardly in the figure, rocker 972 is able to rotatable counterclockwardly, thus shifting plate 974 shown to the right of the marker in an upward fashion, causing the indicator depicted by 980 to move upwardly and to become obscured, but allowing the previously obscured indicators 982 to now be visible through apertures such as 978.

An inset illustration as part of FIG. 11 illustrates how an indicator changing device may use an arm 984 having a bottom roller 986 to move the lever 970 in order to alter the state of the indicators as just described. Arm 984, being rotatable about an axis through connecting rod 988 which is connected to a vehicle through mount 990 incorporates some type of resilient material or, preferably a spring 992, which allows arm 984 to pivot without being damaged as lever 970 is pushed proximate to roller 986 on arm 984. Spring 992 may also allow for slight up and down motion of arm 984 to absorb mechanical stresses due to variations in the ride of the vehicle, particularly if it passes over an uneven road surface. Alternatively, a second spring (not shown) may be utilized in order to accommodate these up and down motions.

I claim:

1. A configurable highway divider system, comprising:

a plurality of markers, spaced apart on a road surface alongside a traffic lane, each marker having a first end which faces traffic travelling in one direction on said lane and a second end which faces traffic in the opposite direction, at least one of said ends including a visual indicator which a vehicle operator may observe to determine the proper direction of travel along said traffic lane; and a vehicle-mountable indicator changing device, whereby a vehicle equipped with said indicator changing device may interact with said markers and change their indicators.

2. The configurable highway divider system of claim 1 wherein said visual indicators use color to indicate the proper direction of travel along said lane.

3. The configurable highway divider system of claim 2 wherein both ends of each marker include visual indicators.

4. The configurable highway divider system of claim 1 wherein said interaction between said vehicle-mounted indicator changing device and said marker is mechanical.

5. The configurable highway divider system of claim 4 wherein said marker includes an externally engageable member mechanically linked to said indicator, said vehicle-mounted indicator changing device including one or more elements which engage with said member, thereby changing said indicator.

6. The configurable highway divider system of claim 5 wherein said externally engageable member is in the form of a slider, said elements of said vehicle-mounted indicator changing device being disposed on a rotatable drum-shaped unit, whereby when said drum-shaped unit is rolled over a marker said elements engage with and move said slider.

7. The configurable highway divider system of claim 5 wherein said externally engageable member is in the form of a lever which protrudes from said marker, said element of said vehicle-mountable indicator changing device including a rigid arm which switches said lever.

8. The configurable highway divider system of claim 4 wherein said indicator changing device is capable of turning a marker about a substantially vertical axis in order to change the indicator observable by a vehicle operator.

9. The configurable highway divider system of claim 8 wherein said indicator changing device is further capable of lifting each marker prior to turning said marker.

10. The configurable highway divider system of claim 5 wherein each visual indicator includes a plurality of different visual attributes disposed on an element that is moveable with respect to said aperture.

11. The configurable highway divider system of claim 10 wherein said visual attributes are disposed on a surface movable with respect to said aperture.

12. The configurable highway divider system of claim 10 wherein said visual attributes are disposed on a rotatable prism-shaped element.

13. The configurable highway divider system of claim 10 wherein said visual attributes are disposed on a rotatable cylindrical element.

14. A configurable highway divider system, comprising:

a plurality of markers, spaced apart on a road surface alongside a traffic lane, each marker having a first end which faces traffic travelling in one direction on the lane and a second end which faces traffic in the opposite direction, one of said ends displaying a visual attribute which signifies that it is safe to proceed along said lane, the other end displaying a visual attribute which signifies that it is not safe to proceed along said lane; and a vehicle-mountable marker changing device which allows a vehicle equipped with said device to interact with each marker on an individual basis and change the visual attributes displayed on the ends of said marker so as to indicate that the flow of traffic has been reversed.

15. A marker that may be used to change the direction traffic along a highway, comprising:

a housing having one end which faces traffic in one direction along said highway and a second end which faces traffic in the opposite direction; and a visual indicator disposed on at least one of said ends, the visual indicator being observable by a vehicle operator to determine the proper direction of travel along said highway, said housing having means disposed therein adapted to receive an externally applied force for changing said indicator to direct traffic from said one direction to said opposite direction.

* * * * *